US009487280B2

(12) United States Patent
Jewell et al.

(10) Patent No.: US 9,487,280 B2
(45) **Date of Patent: *Nov. 8, 2016**

(54) CAPTURE AND DOCKING APPARATUS, METHOD, AND APPLICATIONS

(71) Applicant: FAIRFIELD INDUSTRIES INCORPORATED, Sugar Land, TX (US)

(72) Inventors: Stephen W. Jewell, Alvin, TX (US); Arne Tyler Schilling, Davis, CA (US); William P. Klassen, Davis, CA (US)

(73) Assignee: FAIRFIELD INDUSTRIES INCORPORATED, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/438,689

(22) PCT Filed: Nov. 26, 2013

(86) PCT No.: PCT/US2013/071827

§ 371 (c)(1),
(2) Date: Apr. 27, 2015

(87) PCT Pub. No.: WO2014/085375

PCT Pub. Date: Jun. 5, 2014

(65) Prior Publication Data

US 2015/0284060 A1 Oct. 8, 2015

Related U.S. Application Data

(60) Provisional application No. 61/730,243, filed on Nov. 27, 2012.

(51) Int. Cl.
*B63C 11/34* (2006.01)
*B63G 8/00* (2006.01)
(Continued)

(52) U.S. Cl.
CPC ..... *B63C 11/00* (2013.01); *B63B 27/00* (2013.01); *B63C 1/12* (2013.01); *B63C 11/34* (2013.01);
(Continued)

(58) Field of Classification Search
CPC ..... B63C 1/12; B63C 11/34; B63C 11/42; B63G 2008/002; B63G 2008/004; B63G 2008/005; B63G 2008/007; B63G 2008/008
USPC ..... 405/188, 190, 191
See application file for complete search history.

(56) References Cited

U.S. PATENT DOCUMENTS 4,721,055 A * 1/1988 Pado ..... B63C 11/48 114/330
4,863,314 A * 9/1989 Baugh ..... F16L 37/62 166/338

(Continued)

FOREIGN PATENT DOCUMENTS

WO 9003490 A1 4/1990
WO 0125083 A1 4/2001
WO 03097446 A1 11/2003

OTHER PUBLICATIONS

International Search Form PCT/ISA/220, International Application No. PCT/US2013/071827, pp. 1-9, dated Nov. 26, 2013.

*Primary Examiner* — Frederick L Lagman
(74) *Attorney, Agent, or Firm* — Bond, Schoeneck & King, PLLC; William Greener

(57) ABSTRACT

Apparatus and methods to operationally link (couple/decouple) a plurality of relatively massive, complimentary payload platforms (i.e., suspended machinery and ROV) at relatively deep working depths in an unstable marine environment (water column) while the payload platforms are in-transit. An apparatus includes a suspended machinery, an ROV, a capture collar, an extendable/retractable harpoon, and actuating machinery to controllably effect extension and retraction thereof. A method includes providing an in-transit suspended machinery having a capture collar, providing an in-transit ROV having an extendable/retractable harpoon, approaching the in-transit suspended machinery with the ROV, maneuvering the ROV so as to bring an end of the partially extended harpoon into aligned proximity with the capture collar, and further extending the harpoon so that it securely engages the capture collar.

16 Claims, 17 Drawing Sheets

(51) Int. Cl.

| | |
|---|---|
| ***B63C 11/00*** | (2006.01) |
| ***B63C 1/12*** | (2006.01) |
| ***B63C 11/40*** | (2006.01) |
| ***B63B 27/00*** | (2006.01) |

(52) U.S. Cl.
CPC ..... *B63C 11/40* (2013.01); *B63G 8/001* (2013.01); *B63G 2008/005* (2013.01); *B63G 2008/008* (2013.01)

(56) References Cited

U.S. PATENT DOCUMENTS

| | | | | | |
|---|---|---|---|---|---|
| 5,046,895 | A * | 9/1991 | Baugh | E21B 41/04 | 405/188 |
| 5,425,599 | A * | 6/1995 | Hall | F16L 1/26 | 405/158 |
| 5,458,439 | A * | 10/1995 | Hall | F16L 1/26 | 405/158 |
| 5,593,249 | A * | 1/1997 | Cox | E21B 41/04 | 405/169 |
| 6,167,831 | B1 * | 1/2001 | Watt | B63G 8/001 | 114/245 |
| 6,223,675 | B1 * | 5/2001 | Watt | B63G 8/001 | 114/312 |
| 6,234,717 | B1 * | 5/2001 | Corbetta | E21B 41/04 | 405/158 |
| 6,257,162 | B1 * | 7/2001 | Watt | B63G 8/001 | 114/221 R |
| 6,260,504 | B1 * | 7/2001 | Moles | B63B 27/36 | 114/312 |
| 6,390,012 | B1 * | 5/2002 | Watt | B63B 27/36 | 114/322 |
| 6,789,587 | B2 * | 9/2004 | Mossman | A01G 23/08 | 114/315 |
| 7,213,532 | B1 | 5/2007 | Simpson | | |
| 2004/0258482 | A1 * | 12/2004 | Mackinnon | E21B 41/04 | 405/188 |
| 2005/0160959 | A1 | 7/2005 | Roodenburg et al. | | |
| 2005/0276665 | A1 * | 12/2005 | Entralgo | B63C 11/42 | 405/190 |
| 2009/0052992 | A1 * | 2/2009 | Thompson | B63C 11/40 | 405/158 |
| 2009/0095209 | A1 * | 4/2009 | Jamieson | B63G 8/001 | 114/312 |

* cited by examiner

CAPTURE AND DOCKING APPARATUS, METHOD, AND APPLICATIONS

RELATED APPLICATION DATA

The instant application derives priority from U.S. provisional application Ser. No. 61/730,243 filed Nov. 27, 2012, the subject matter of which is herein incorporated by reference in its entirety.

BACKGROUND

1. Field of the Invention

Embodiments of the invention are generally in the field of equipment handling in an unstable medium (e.g., water) and, more particularly relate to apparatus and associated methods for capturing, docking, managing, releasing, loading, unloading, reloading, and/or otherwise controllably manipulating at least two inter-connecting payload platforms disposed in an unstable medium, and applications thereof. Even more particularly, embodiments relate to capturing, docking, and releasing at least two moving (i.e., in transit), relatively massive, inter-connecting payload platforms in water at depths up to or exceeding several thousand feet, and effecting operational deployment, including capturing, loading, holding, releasing, discharging, unloading, reloading, transferring, and/or other controlled management and/or manipulation of an identified payload between the payload platforms, and applications thereof.

2. Related Art

Seismic data, long utilized in oil exploration, is increasingly being used not only for exploration, but also in production, development, and exploitation of already producing oil fields, and is typically referred to in the art as 'exploitation seismic.'

In the marine environment, seismic data has conventionally been collected from surface vessels towing long streamers of receivers, and introducing energy with air guns towed behind the same or a separate source vessel. During the past decade, autonomous ocean bottom receivers called 'nodes' or ocean bottom seismometers (OBS) have been developed. Nodes contain their own power source and record seismic data passively and continuously from the time they are placed on the sea bed and started until stopped and/or retrieved.

Three dimensional seismic imaging has been common for three decades, but in recent years, as exploitation seismic has matured, the fourth dimension, time, has importantly emerged. In 4D seismic, the identical (as nearly as possible) 3D seismic programs are repeated at time intervals ranging from a few months to a few years, and those results are then compared. The differences can be and are attributed to the changes in the oil field itself as a function of production. This in turn allows the oil field production managers to better place future wells and/or manage their injectors and current production wells to maximize the exploitation of the resource.

The costs of ocean bottom recording typically significantly exceeds that of surface seismic, predominantly incurred through the placing and recovering of the ocean bottom equipment. As oil production moves to deeper and deeper waters, these costs escalate. In the case of nodes in very deep water, the nodes are placed and recovered by heavy work class remotely operated vehicles (ROVs), which are not only expensive on their own, but also require pilots, other crew, redundancy, maintenance, power, and deck equipment further requiring larger vessels, which together make these operations exceedingly expensive. Due to the expense, ocean bottom receivers are generally placed on a very course (e.g., 200 to 600 meter) grid and are shot into with a fine surface source grid. However, merely transiting a large grid with an ROV(s) and ROV equipped vessel involves substantial time and expense.

In deep water, ROVs are most often launched and recovered from surface vessels or platforms coupled with their tether management system (TMS). Together the TMS and ROV are overboarded and suspended in the water column from the surface by an umbilical. The umbilical is usually a heavy armored cable that carries power and data connections therein, connecting the ROV/TMS to the surface. When at operating depth, the ROV is disengaged from the TMS and is able to 'fly free' of the TMS connected by a much lighter and more flexible cable called a tether. Like the umbilical, the tether transmits power and data between the ROV and the TMS via conductors. The TMS remains suspended in the water column beneath the surface vessel or platform by way of the umbilical.

Recovering the ROV is a two step process. The ROV must return to and dock safely with its TMS, the TMS recovering slack tether in the process. Once joined, they are winched back to the surface with the umbilical. Both operations may involve substantial hazards. In the case where the TMS is suspended from a surface vessel, it is subject the same motion (in some cases amplified motion) as the surface vessel unless heave compensation is employed. Various heave compensation means are available but all are expensive and add wear and tear on the umbilical, another exceedingly expensive item.

The joined TMS and ROV are highly susceptible to damage when transiting the air/water interface until safely secured in position on the deck, predominantly due to the motion of the vessel. Together with the fact that recovering the package from great depths can itself be time consuming, minimizing the number of times the ROV must be recovered to the vessel is crucial to efficient operations. In addition, there are safety concerns for the crew during recovery operations not present when the ROV(s) remains at depth.

For ROVs engaged in deploying nodes and other OBS system components, subsea reloading of the ROV with suitable components is a desirable alternative to recovering the ROV and reloading it on the surface. Several mechanisms to permit this are in use; for example, U.S. Pat. No. 7,632,043 discloses a second device (reloader) that is loaded on a surface vessel with a replacement payload for the ROV. This device and payload are lowered through the water column to the sea bed in close proximity to the ROV. The ROV, flying free of its TMS on its tether and using fixtures and machinery it carries designed specifically for this purpose, engages with the reloader and effects an exchange of the payload from the reloader to the ROV. After the exchange, the ROV departs the reloader and continues its mission on the sea floor while the reloader is winched back to the surface and back aboard the vessel.

As disclosed, this exchange is conducted on the sea floor for a very practical reason: the reloader is stationary on the bottom and not subject to vertical motion owing to the surface vessel's heave to which it is subject during its descent/ascent. However there are both hazards and time consuming problems associated with landing this heavy machinery on the sea bottom. The sea bed contour may not be suitable to land the reloader, or there may be other expensive ocean bottom assets that must be avoided requiring the surface vessel to reposition itself and all the suspended equipment to a more suitable location. Moreover, where the bottom is soft and or mud, visibility required to engage the reloader can be obstructed for long periods of time owing to the light currents generally encountered at significant ocean depths.

In regard to productivity, the necessity of landing the reloader on the sea bottom to effect the transfer requires the surface vessel to stop and hold position on the surface. While the transfer is in progress and until concluded, all production is halted, even in the event a second ROV, which still has payload, is in use.

For all of the foregoing reasons and others appreciated by those skilled in the art, there exist a need to effect the exchange of nodes between a surface vessel and an ROV operating at depth without the need to land a reloading device on the ocean bottom. Furthermore, if the transfer can be accomplished in the mid-water column while the surface vessel, TMS, and loader are all in transit and advancing on the next deployment or recovery location, then the reload operation may require no additional time to execute.

DEFINITION OF TERMS

The following terms, among others, will be used herein in describing non-limiting, exemplary, and illustrative embodiments and aspects of the invention, and are described below to assist the reader in clearly understanding the invention.

Water Column: The vertical (depth) volume of water between the surface and sea bottom wherein marine seismic-related activities are being conducted. Mid-water column refers to a depth intermediate the surface and the sea bottom where, e.g., 'suspended machinery' may be operationally positioned.

Remotely Operated Vehicle (ROV): a submersible, remotely-controlled vehicle generally coupled to a tether management system (TMS), and considered a 'payload station.' Free flying ROV refers to an ROV that has been mechanically disconnected from its TMS and joined to its TMS only by means of the flexible tether allowing it to move independently of that TMS. The TMS is further connected to a surface or near surface vessel, platform or other structure by means of an umbilical. Together the tether and umbilical carry power and data between the ROV and the surface.

Suspended Machinery: a structure suspendable in the water column and including a 'payload,' adapted to enable docking with, e.g., an ROV and transferring a payload there between; also considered a 'payload platform.' The suspended machinery may be coupled to heave compensation apparatus.

Operational transit: The suspended machinery is attached to a cable (which may include a heave compensation means) connected to a surface vessel. According to an advantageous aspect of the invention, the surface vessel may be in transit (i.e., forward motion), towing the suspended machinery at depth through the water; thus, the suspended machinery is likewise 'in transit.' The ROV intended to couple with the suspended machinery will thus also be 'in transit' during operation of the docking procedure.

Payload Cage: a structure capable of housing receiving, holding, and discharging one or more 'unit payloads.'

Node: an ocean bottom sensor (OBS) or seismic sensor device representing a 'payload' or 'unit payload.'

SUMMARY

Embodiments of the invention are apparatus and methods to operationally link (couple/decouple) a plurality of relatively massive, complimentary payload platforms (i.e., suspended machinery and ROV) at relatively deep working depths in an unstable marine environment (water column) while the payload platforms are in-transit.

One exemplary embodiment of the invention is an apparatus that enables the coupling or linking by an in-transit ROV in a water column with an in-transit suspended machinery in the water column that is suspended by a link from an in-transit marine surface vessel, platform, or other surface or sub-surface structure. The apparatus includes a suspended machinery, an ROV, at least one capture collar affixed to the ROV or the suspended machinery, an extendable/retractable harpoon respectively connected to the suspended machinery or the ROV, and actuating machinery associated with the extendable/retractable harpoon to controllably effect extension and retraction thereof. According to various exemplary, non-limiting aspects, the apparatus may additionally include one or more of the following components, assemblies, features, limitations or characteristics:

- wherein a distal end of the harpoon includes a controllable capture collar latching mechanism
  - wherein the controllable capture collar latching mechanism includes a retractable component in the form of a barb or a finger;
  - wherein the controllable latching mechanism is remotely activatable;
- wherein the capture collar has a front end and a back end, further wherein the capture collar is characterized by a cone-like geometry having a progressively narrowing dimension between the two ends;
- wherein the harpoon is rigid;
- wherein the harpoon is flexible;
- further comprising a set of complimentary alignment fixtures attached to respective ones of the ROV and the suspended machinery;
  - wherein the set of complimentary alignment fixtures comprises an elongate, tapered male structure and a tapered female structure that can engage the male structure.
    - wherein the female alignment fixture is disposed on the ROV and the male alignment fixture is disposed on the suspended machinery;
- further comprising a payload cage associated with at least one of the ROV and the suspended machinery that has a capacity for receiving, holding, and discharging a unit payload.

An exemplary embodiment of the invention is a method for coupling an in-transit ROV in a water column with an in-transit suspended machinery in the water column that is suspended from a link from an in-transit marine surface vessel, platform, or other surface or sub-surface structure. The method includes the steps of providing an in-transit suspended machinery having at least one capture collar, providing an in-transit ROV having an extendable/retractable harpoon, approaching the in-transit suspended machinery with the ROV, wherein the extendable/retractable harpoon is partially extended so as to maintain a given distance between the ROV and the in-transit suspended machinery, further wherein the partially extended harpoon is aligned with one of the capture collars on the suspended machinery, maneuvering the ROV so as to bring an end of the partially extended harpoon into aligned proximity with the capture collar, and further extending the harpoon so that it securely engages the capture collar. According to various exemplary, non-limiting aspects, the method may additionally include one or more of the following steps, components, assemblies, features, limitations or characteristics:

further comprising at least partially retracting the engaged harpoon so as to draw the ROV and the suspended machinery closer to one another into a securely coupled arrangement;

further comprising de-activating a latching mechanism on a distal end of the harpoon and reducing an in-transit speed of the ROV to a value that is less than the in-transit speed of the suspended machinery so as to increase the separation distance between the in-transit suspended machinery and the ROV;

further comprising transferring a unit payload disposed within at least one of the ROV and the suspended machinery to the respective suspended machinery and the ROV;

further comprising activating a latching mechanism on a distal end of the harpoon to securely engage the capture collar.

BRIEF DESCRIPTIONS OF FIGURES

Figure 1:
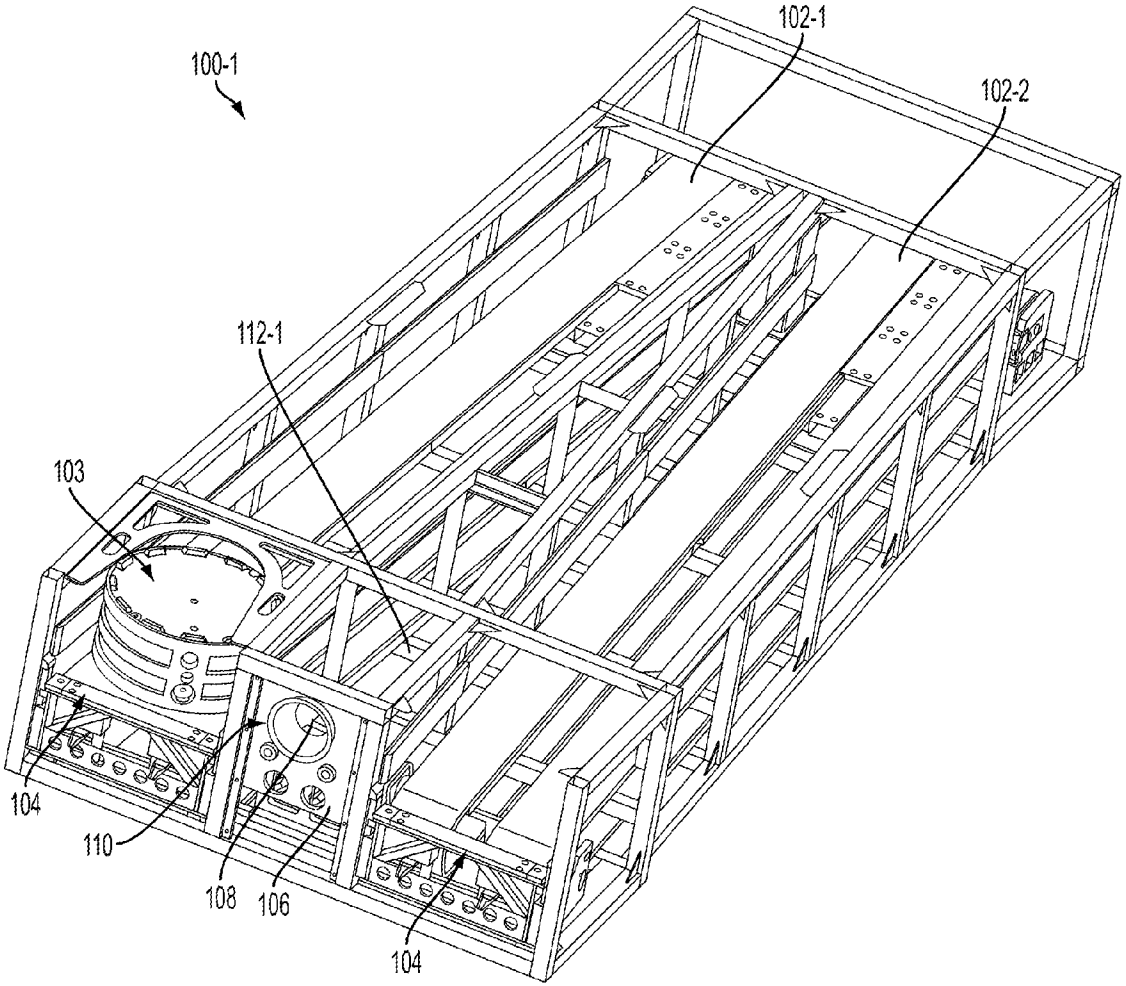
FIG. 1 shows a payload cage that may be part of a suspended machinery or an ROV, including a capture collar, according to an exemplary aspect of the invention.
Figure 2:
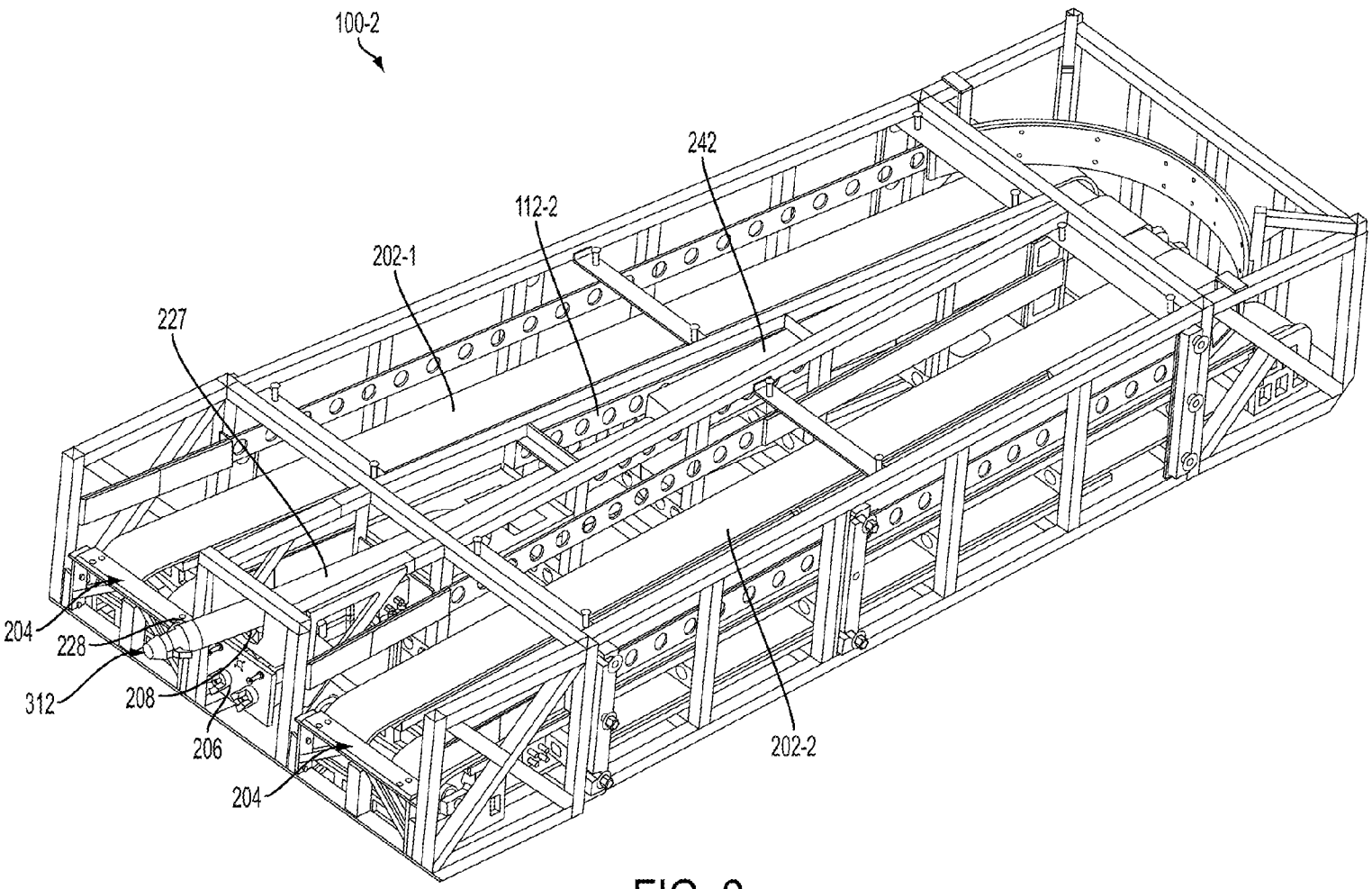
FIG. 2 shows a payload cage that may be part of a suspended machinery or an ROV, including an extendable/retractable harpoon, according to an exemplary aspect of the invention.
Figure 4:
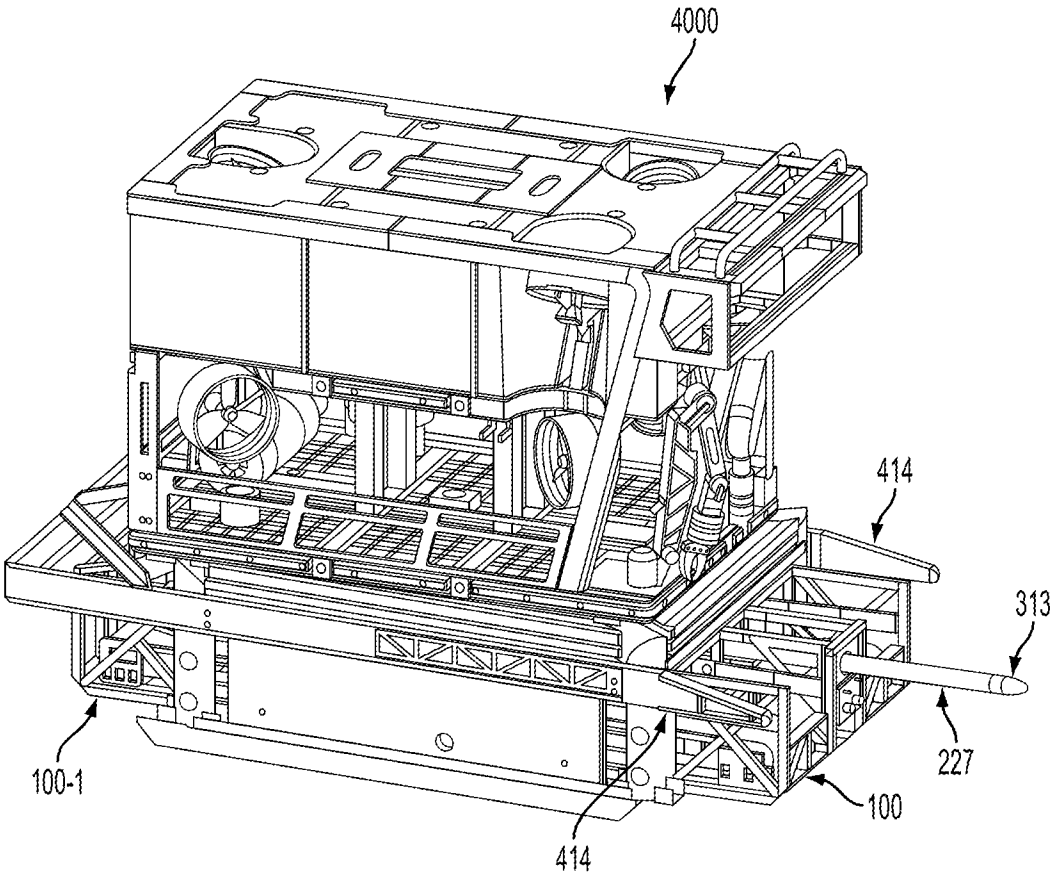
Figure 5:
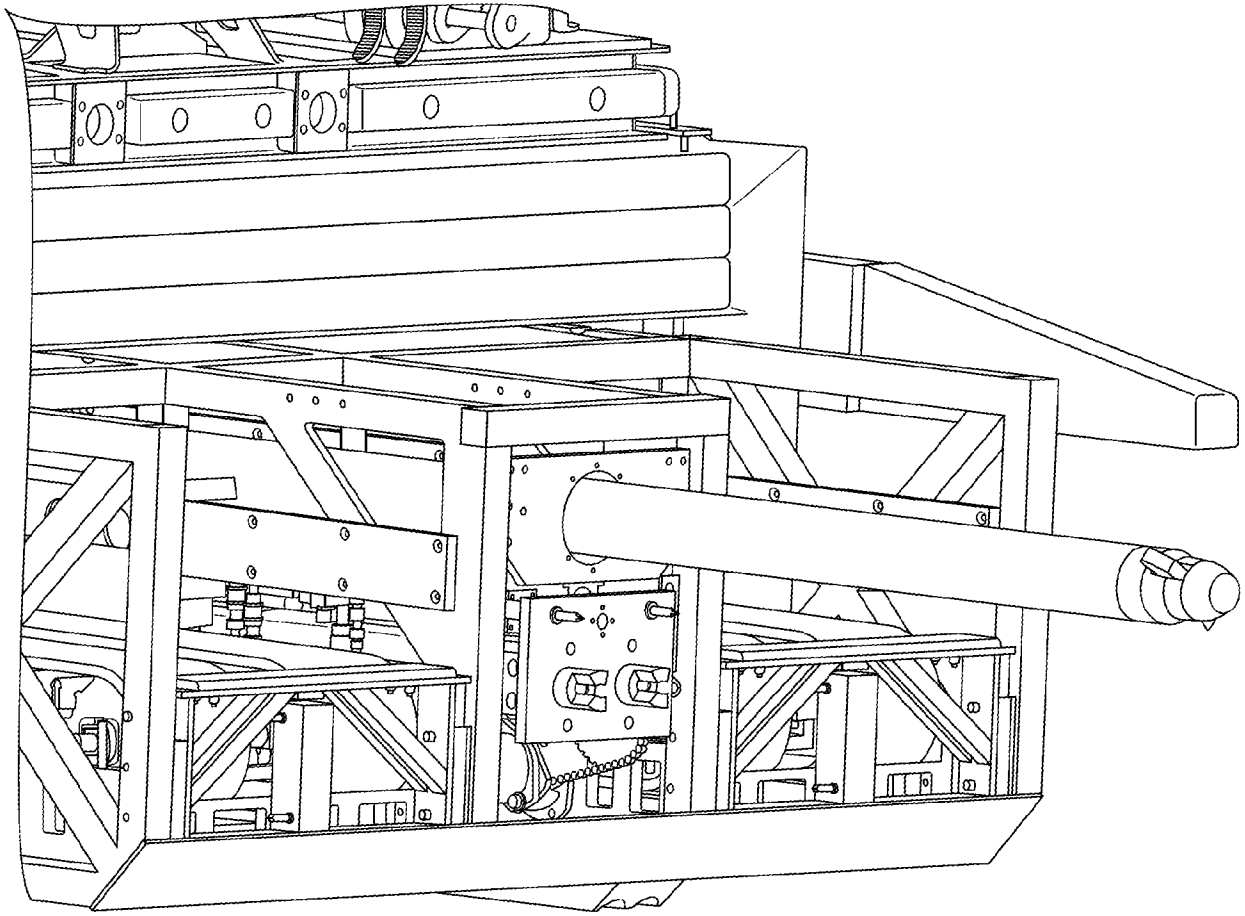
Figure 6:
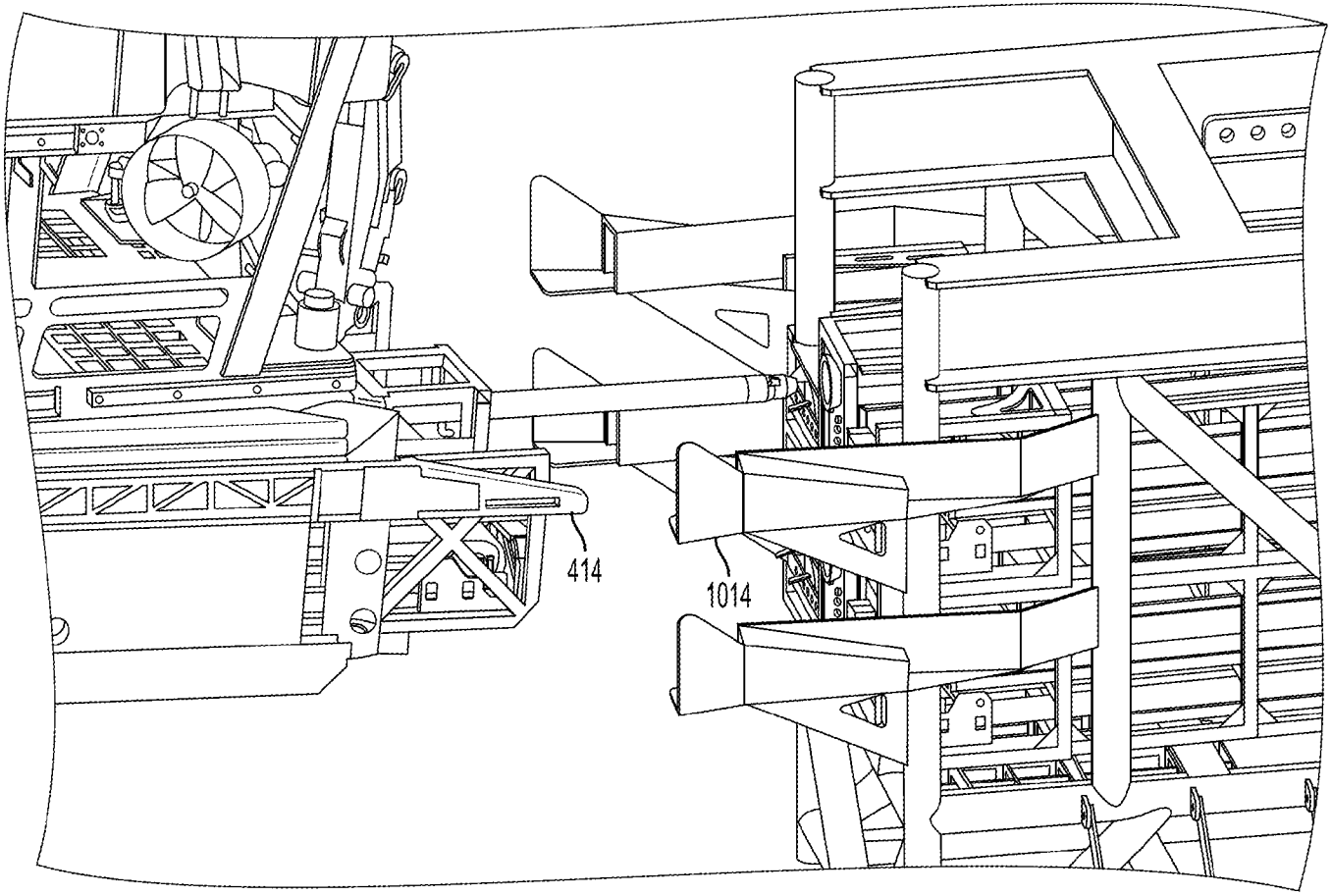
Figure 7:
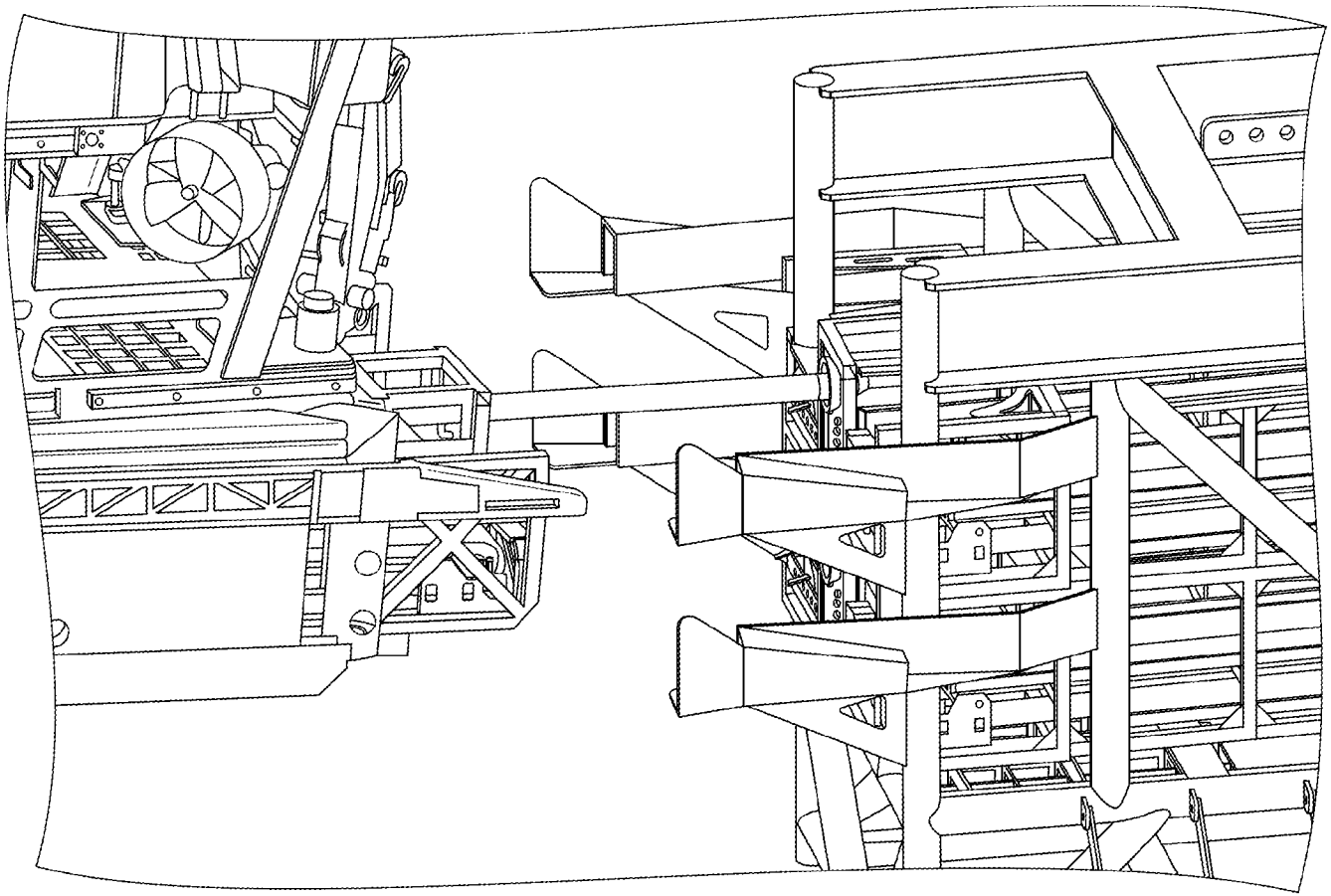
Figure 8:
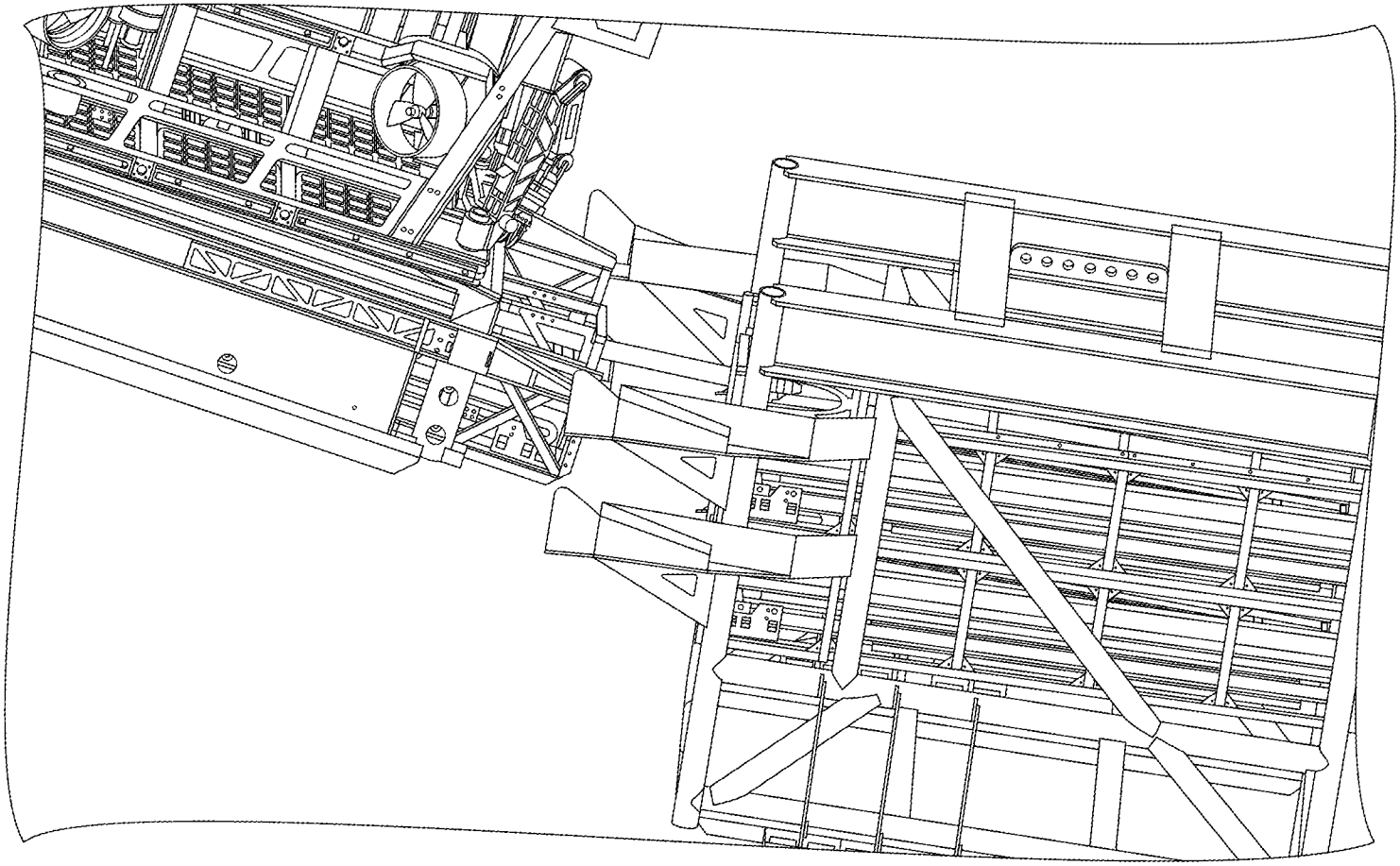
Figure 9:
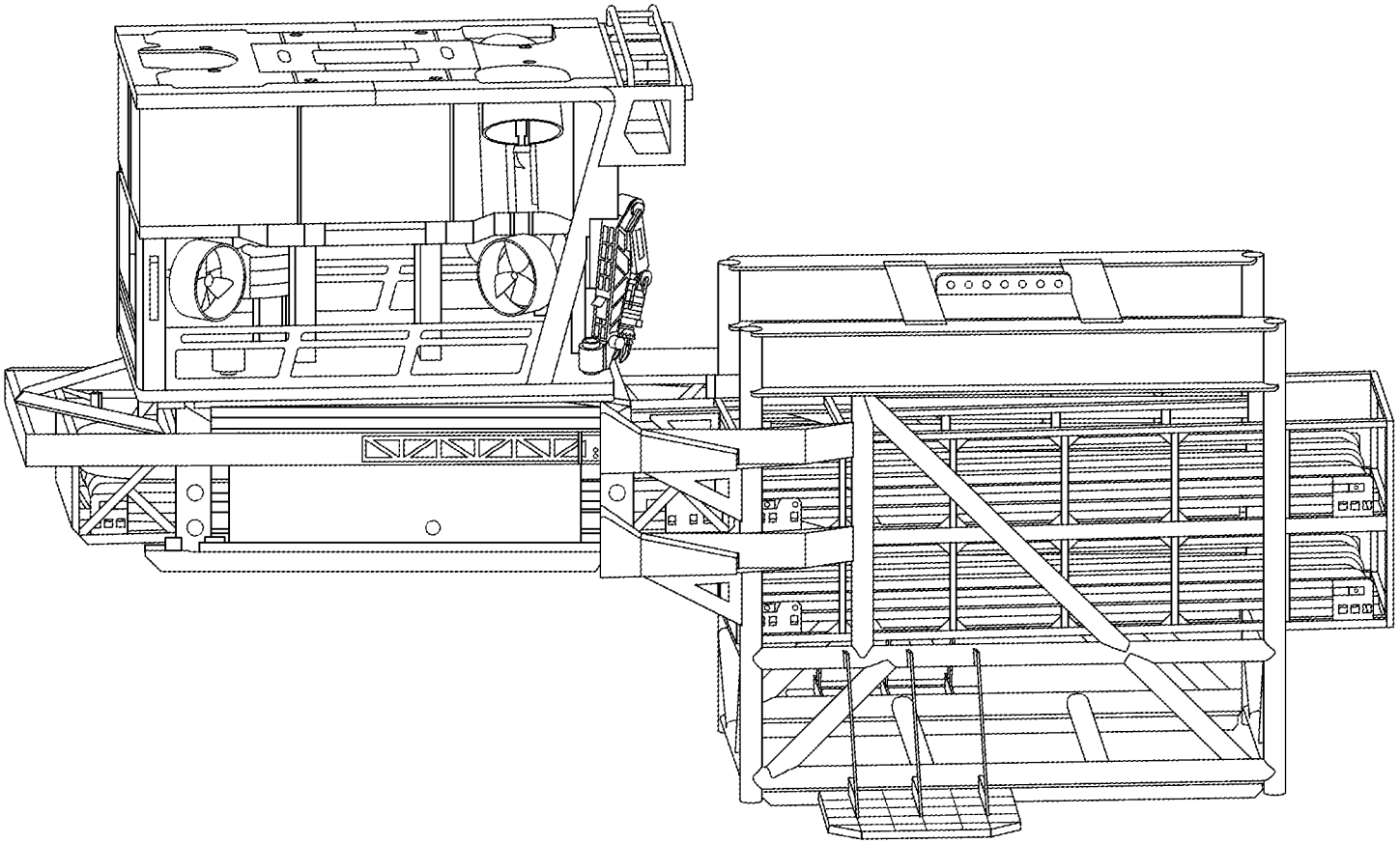
Figure 10:
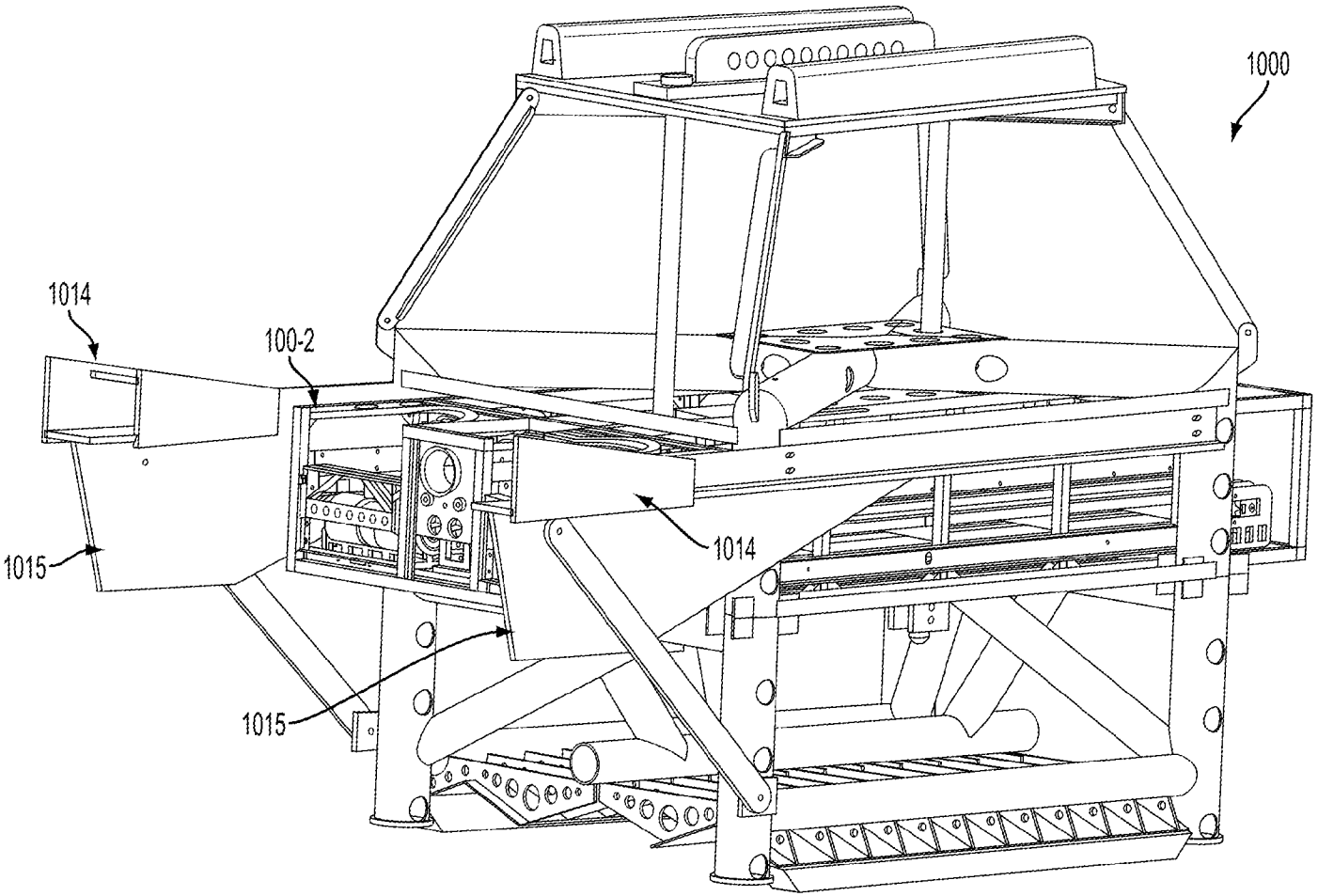
Figure 11:
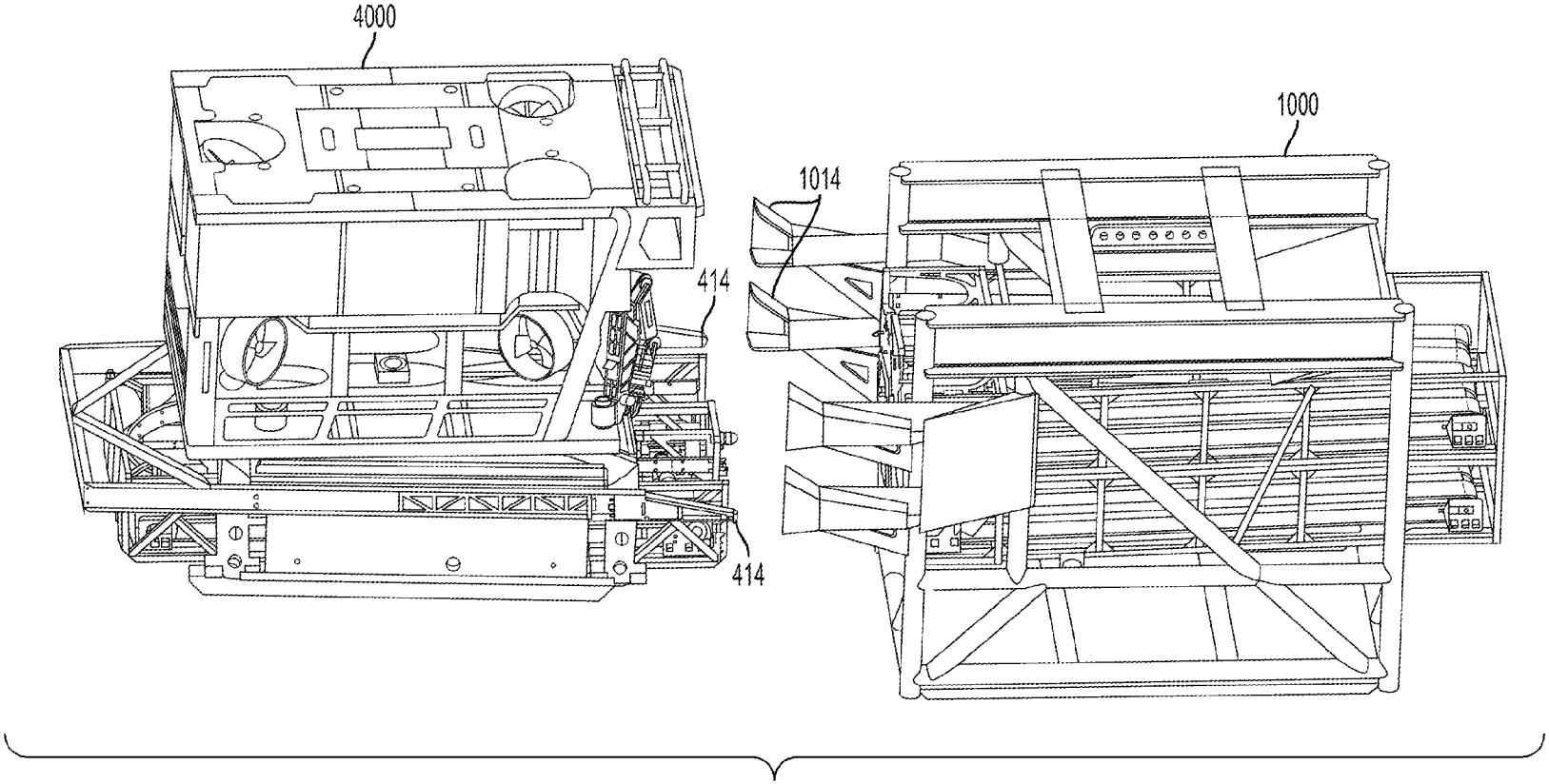
Figure 12:
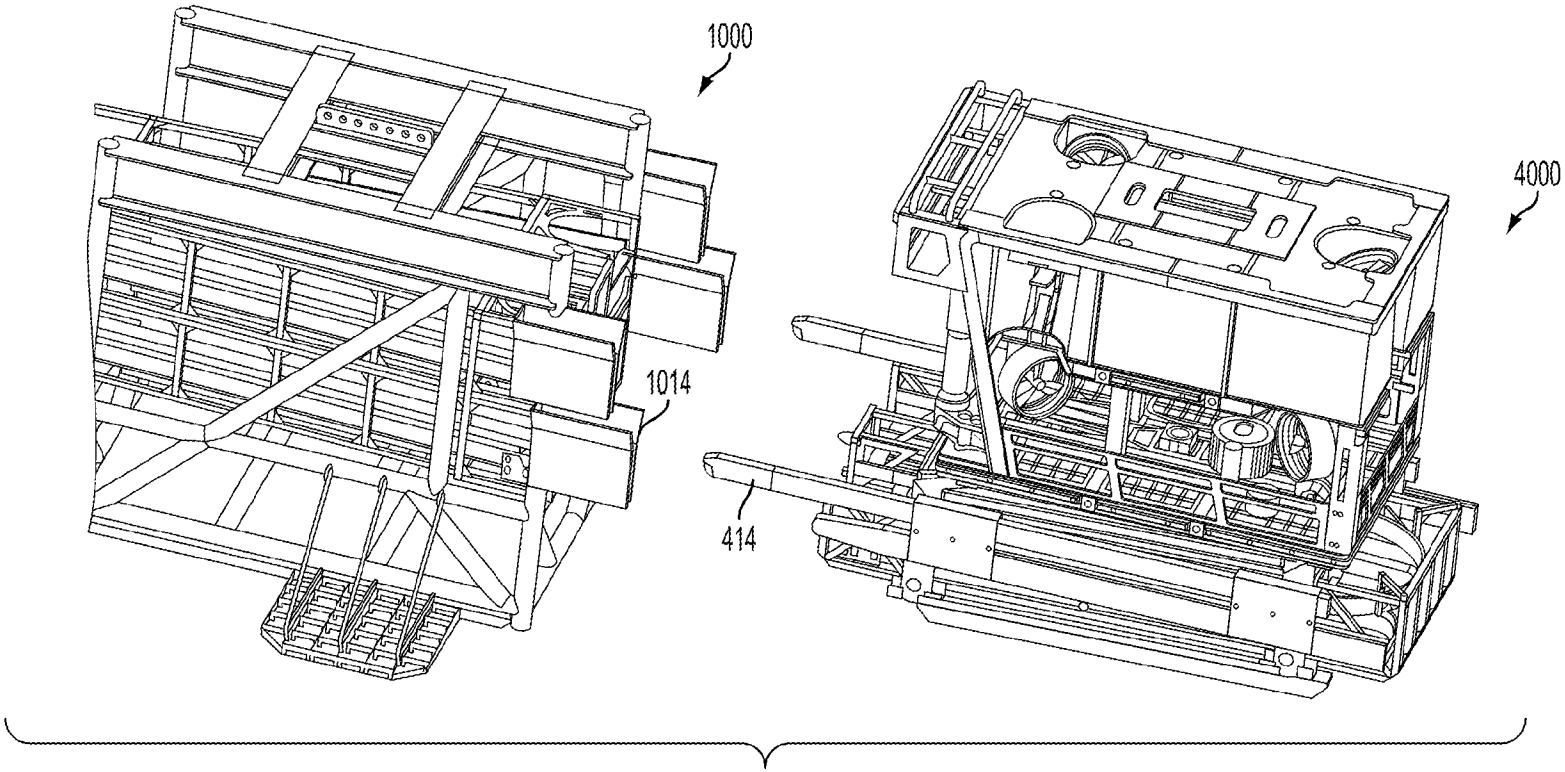
Figure 13:
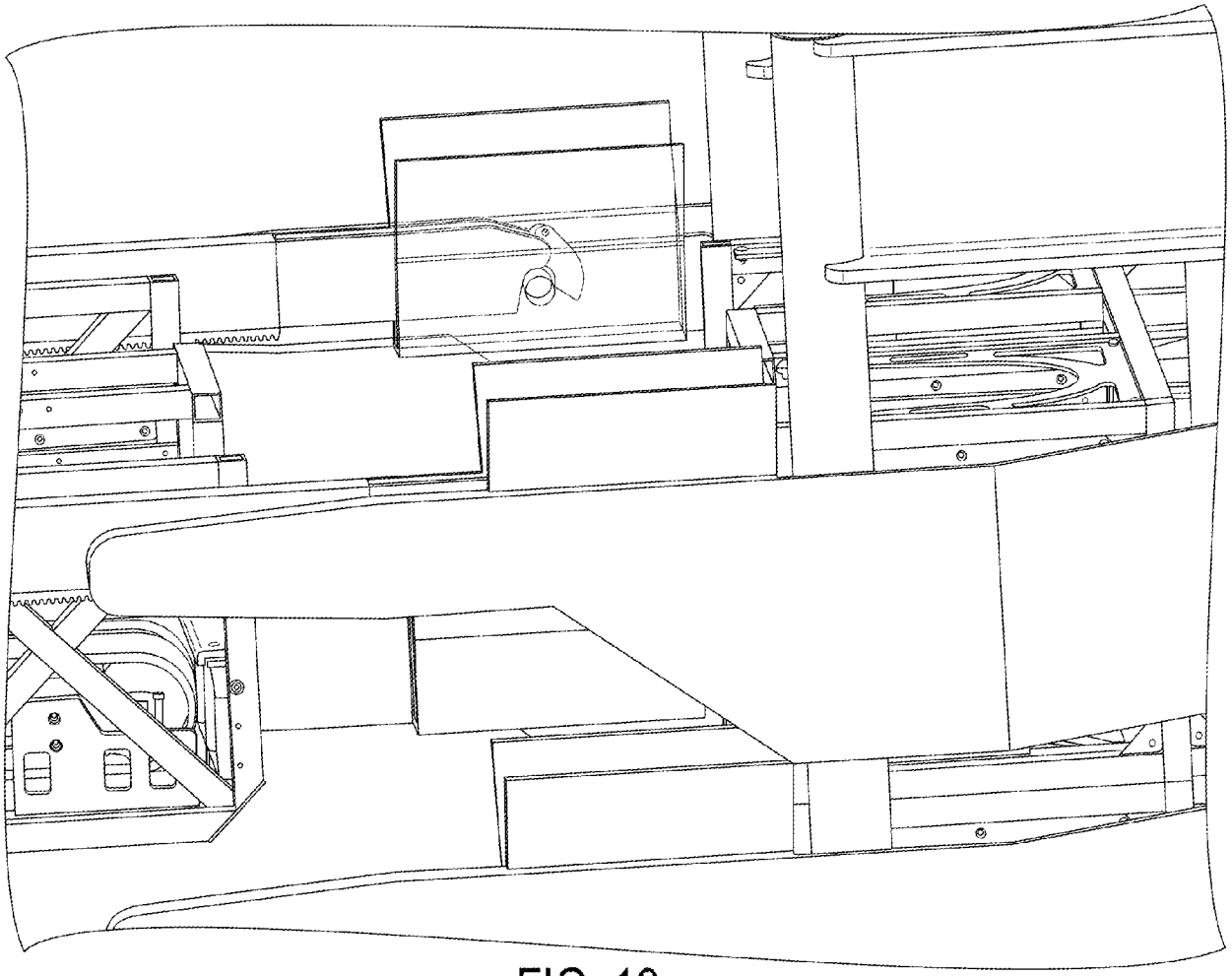
Figure 14:
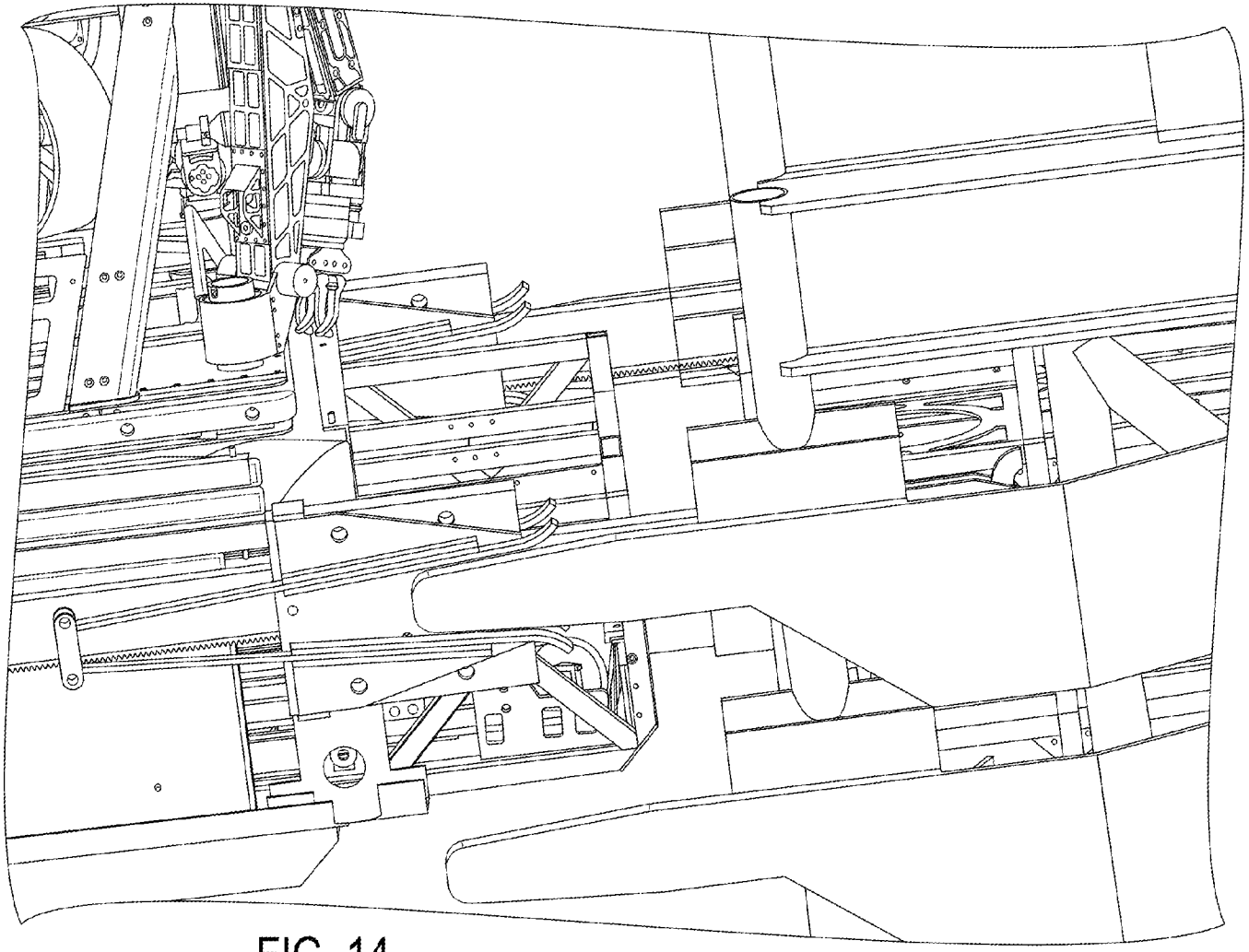
Figure 15:
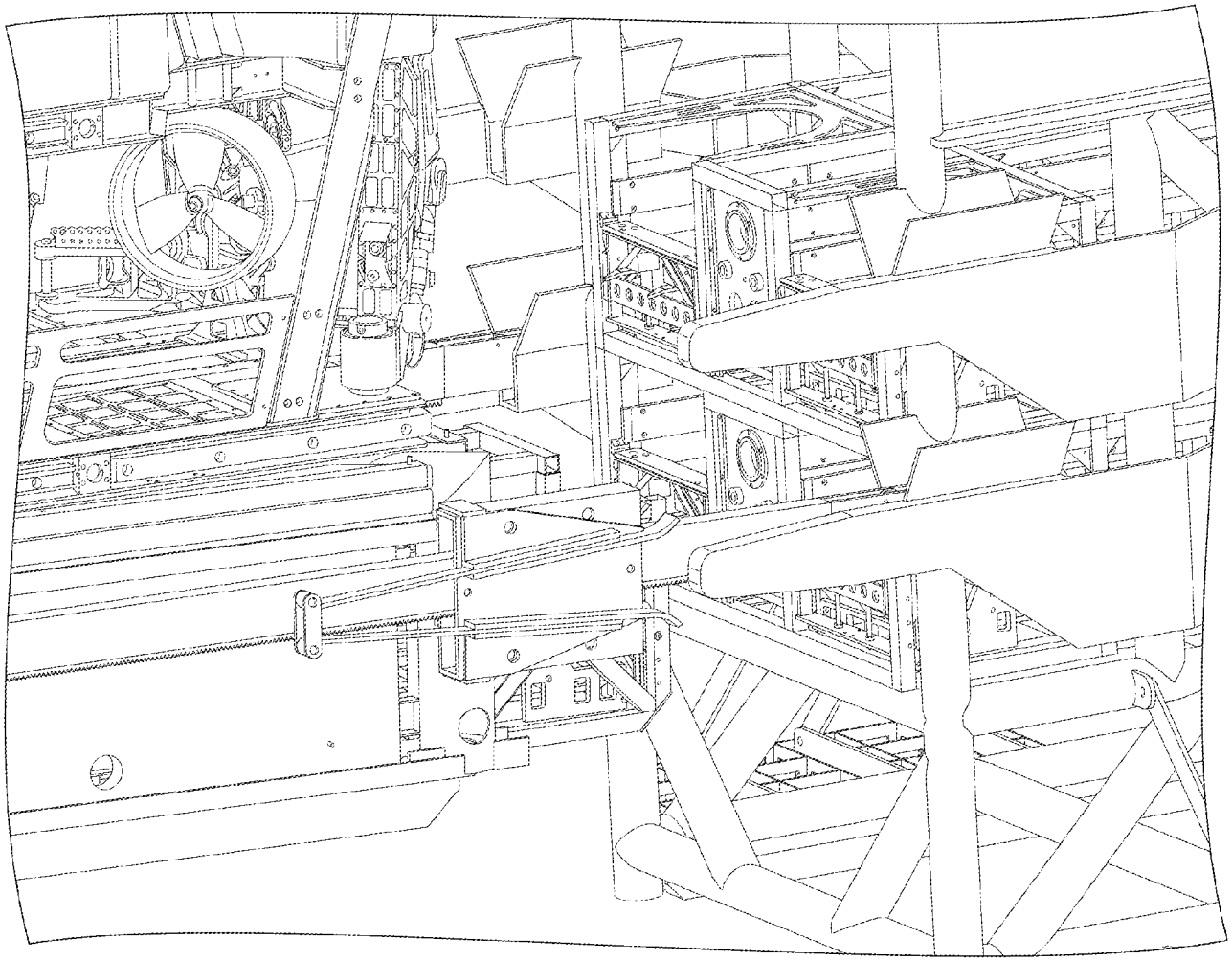
Figure 16:
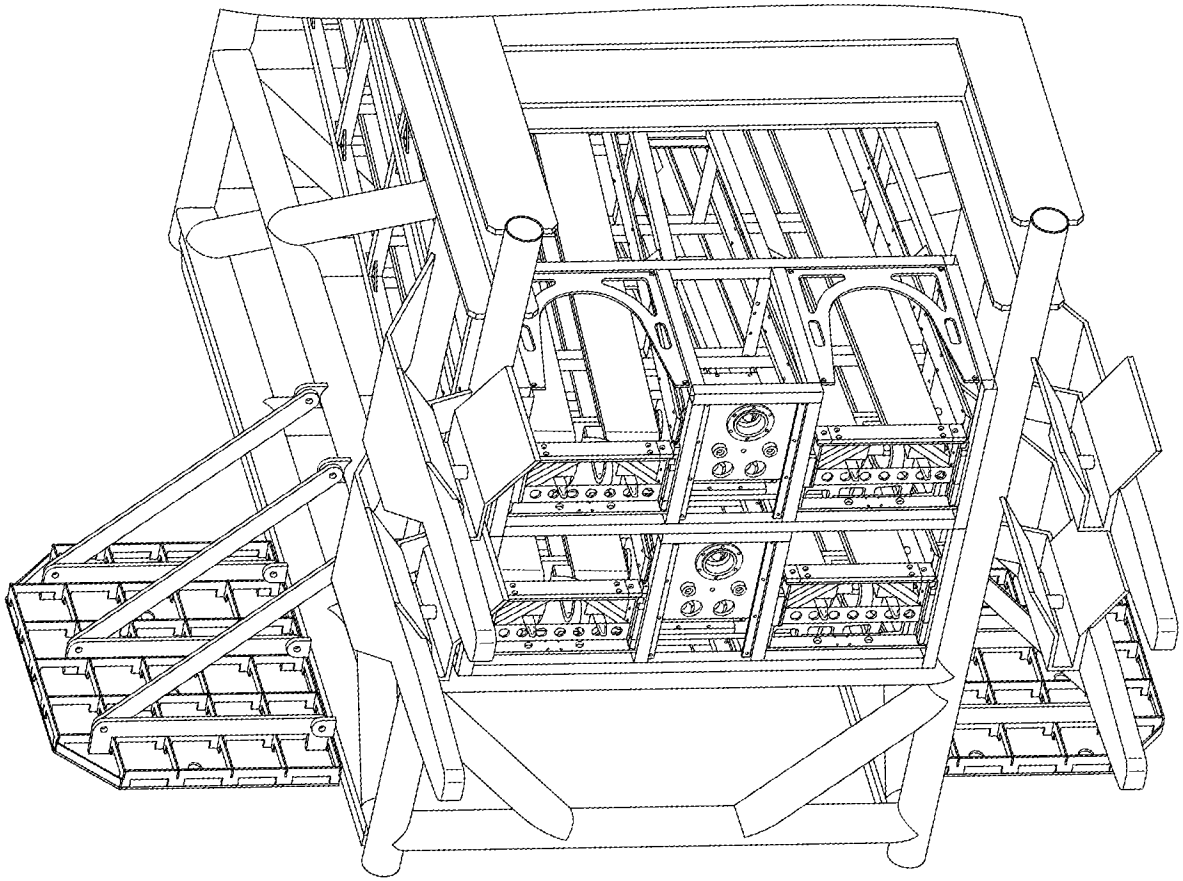
Figure 17:
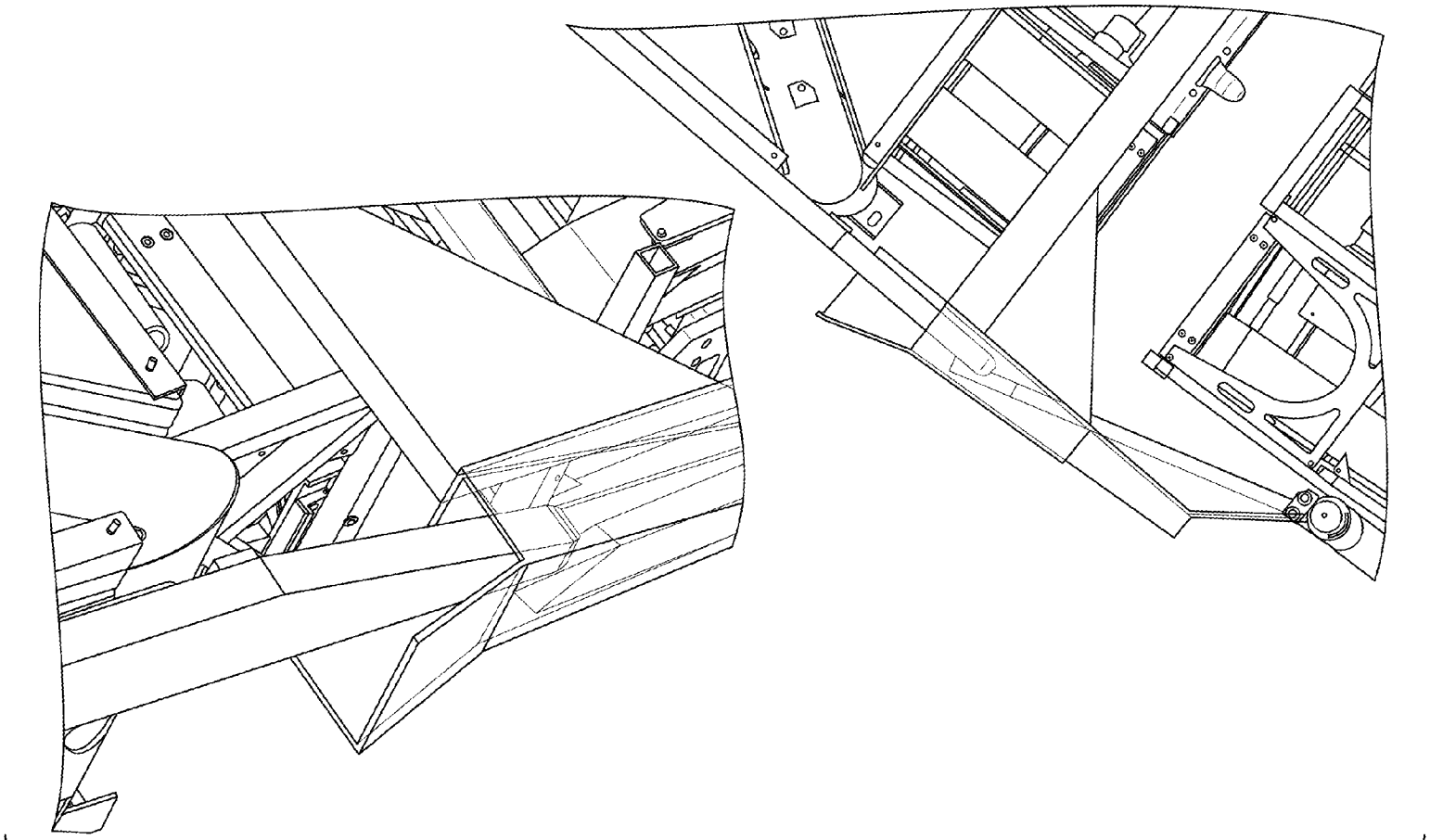

FIG. 4 schematically shows an ROV with an attached payload cage including an extendable/retractable harpoon as illustrated in FIG. 2, according to an exemplary aspect of the invention;

FIG. 5 shows a semi-flexible, partially extended harpoon according to an illustrative aspect of the invention;

FIGS. 6-9 schematically, sequentially illustrate a linking/coupling/docking procedure between the in-transit suspended machinery and the ROV, according to an illustrative embodiment of the invention;

FIG. 10 schematically shows a suspended machinery with an attached payload cage including a capture collar as illustrated in FIG. 1, according to an exemplary aspect of the invention;

FIG. 11 schematically shows an in-transit suspended machinery and a free-flying ROV with retracted harpoon approaching the suspended machinery, according to an illustrative embodiment of the invention;

FIG. 12 shows a different perspective view of FIG. 11 more clearly illustrating a set of complimentary male and female alignment fixtures attached to respective ones of the ROV and the suspended machinery, according to an illustrative aspect of the invention;

FIGS. 13-15 illustrate various operational aspects of complimentary male and female alignment fixtures engaging or engaged, according to illustrative aspects of the invention;

FIG. 16 schematically illustrates a suspended machinery with two attached payload cages each including a capture collar as illustrated in FIG. 1, according to an illustrative aspect of the invention; and FIG. 17 schematically illustrates optional extended landing surfaces attached to the female alignment fixtures to facilitate a docking procedure, according to an illustrative aspect of the invention.

DETAILED DESCRIPTION OF EXEMPLARY, NON-LIMITING EMBODIMENTS OF THE INVENTION

Embodiments of the invention relate to capturing, docking, and releasing at least two in-transit, relatively massive, inter-connecting payload platforms (e.g., 'suspended machinery' and 'ROV') disposed in a water column at depths up to or exceeding several thousand feet, and effecting operational deployment, including capturing, loading, holding, releasing, discharging, unloading, reloading, transferring, and/or other controlled management and/or manipulation of an identified payload (e.g., payload cage(s) or unit payloads such as 'nodes' or ocean bottom sensors (OBSs)) between the payload platforms.

Generally speaking, suspended machinery will be disposed in a mid-water column via a cable sourced from a surface vessel. The suspended machinery will include either a dedicated payload cage that stays with the suspended machinery and contains unit payloads (hereinafter, 'nodes'), which can be received into, held by, and discharged from the payload cage or, a modular payload cage which itself can be received into, held by, and discharged from the suspended machinery. Although the suspended machinery may be stabilized in the water column by heave compensation means (not part of the invention per se), the suspended machinery may be moving transversely through the water (i.e., in-transit) by virtue of being connected to the surface vessel under steam.

The ROV is controllably 'free flying' through the water via its tether management system coupled to the moving surface vessel. The ROV will include either a dedicated payload cage that stays with the ROV and contains nodes, which can be received into, held by, and discharged from the payload cage or, a modular payload cage which itself can be received into, held by, and discharged from the ROV.

The solution provided by the embodied invention is to effect efficient transfer of either a payload cage or a node (unit payload) between the moving suspended machinery and the free-flying ROV in the unstable marine environment.

According on an exemplary embodiment, both the suspended machinery and the ROV each include at least one dedicated payload cage and complimentary capture/release/docking apparatus incorporated into the suspended machinery assembly and the ROV assembly to efficiently effect docking operations and transfer of nodes between the suspended machinery and the ROV.

FIG. 1 shows a first payload cage 100-1 including a first docking assembly 106 disposed on the trailing face of the cage. The docking assembly has a through-opening 108 with a perimetal capture collar 110 secured therein, shown centered at the trailing end of an elongate open region 112 of the cage between two node runways 102-1, 102-2 (which may be separate as shown, e.g., in FIG. 1 or operationally interconnected as illustrated, e.g., in FIG. 2) for shuttling nodes, and showing a node 103 on a runway near an access opening 104 at a trailing edge of the cage. The payload cage 100-1 including the docking assembly may be part of either the suspended machinery 1000 (FIG. 10) or alternatively, part of the ROV. From an operational standpoint, it is more advantageous for the payload cage including the docking assembly to be associated with the suspended machinery rather than with the ROV; therefore, the embodiments disclosed herein below will be described and illustrated according to this non-limiting aspect of the invention.

Figure 3:
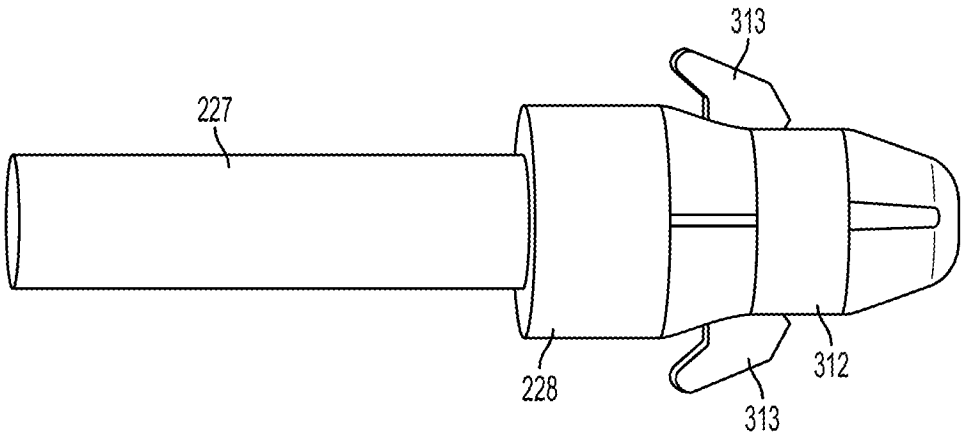
FIG. 3 shows the distal end of a harpoon including a latching mechanism, according to an illustrative aspect of the invention.

FIG. 2 illustrates a complimentary, second payload cage 100-2 including a second docking assembly 206 disposed on the leading face of the cage 100-2. The second docking assembly 206 has a through-opening 208 and a retractable/extendable harpoon 227 extendably disposed in the through-opening 208 and into an elongate open space 112-2 behind the second cage docking assembly 206. The harpoon 227 has a distal end 228 (FIG. 3) that includes an extendable/retractable catching/latching mechanism 312, illustrated, for example, in FIG. 3 as barbs or fingers 313. It will be appreciated that the extendable/retractable latching mechanism could alternatively be in the form of a ring, collar, or other shape such that, in any event, as the distal end of the harpoon is inserted through the collar 110 of the first cage docking assembly 106, the latching mechanism 312 collapses to allow ingress of the extending harpoon through the through-opening 108 of the first cage docking assembly 106 and into the free space 112-1 behind the first cage docking assembly 106. Once through, the latching mechanism opens or flares out to prevent egress of the extended harpoon unless/until the latching mechanism is controllably collapsed or retracted. The harpoon 227 is further coupled to actuating machinery 242 disposed in the second payload cage 100-2 as illustrated in FIG. 2. The actuating machinery 242 effects retraction and extension of the harpoon. Such actuating machinery may be implemented by hydraulic cylinder, chain and sprocket, rack and pinion, and other actuating mechanisms known in the art. The harpoon may be semi-flexible or rigid. A semi-flexible construction provides a measure of safety for both machines in the event of a docking miss and tolerance in the event of poor alignment when the harpoon is actuated for docking. The second payload cage 100-2 is advantageously a part of the ROV 4000 (FIG. 4) and includes, as illustrated, dual, interconnected node runways 202-1, 202-2 terminating at leading end cage access openings 204.

Either or both of the first and the second payload cages can be dedicated components of the suspended machinery and the ROV or attachable/detachable components. Either way, as can be understood with further reference to FIGS. 4-9, when it is desired to dock the ROV with the in-transit suspended machinery, the ROV is operated to approach the suspended machinery. As it begins to close distance, the extendable/retractable harpoon is partially extended while maintaining a given distance between the ROV and the in-transit suspended machinery. The partially extended harpoon is aligned with the (or one of the) capture collar on the suspended machinery. The ROV is then further maneuvered so as to bring the end of the partially extended harpoon into aligned proximity with the capture collar, and the harpoon is then further extended so that it passes through the opening of the capture collar and is securely engaged therewith via operation of the extended latching mechanism. The harpoon is then retracted, drawing the ROV towards the suspended machinery as both are in-transit to enable docking and coupling of the ROV and the suspended machinery. Once docked, nodes may be transferred between the first and second payload cages. Upon completion of the node transfer operation, the latching mechanism can be controllably disengaged, allowing the ROV to decouple from the in-transit suspended machinery and again fly-free and perform its operational functions.

With reference to FIGS. 4, 6 and 10-15, to further assist in the docking operation, the suspended machinery and the ROV may be equipped with complimentary (e.g., male (414)/female (1014)) alignment fixtures. FIG. 4 in particular shows an illustrative aspect in which the ROV 4000 has a set (two) of stationary, elongate, male alignment fixtures 414 protruding from a leading end of the ROV. Corresponding thereto, as illustrated, e.g., in FIG. 10, the suspended machinery 1000 has a complimentary set (two) of stationary, female alignment fixtures 1014 protruding from the trailing end thereof. More than one set of either male and/or female alignment fixtures may be provided and they may be attached to the cage portion of the payload station. FIG. 10 further shows hydrodynamic stabilization wings 1015 connected to the suspended machinery.

FIG. 11 shows a schematic perspective view of a suspended machinery 1000 and an ROV 4000 (undocked) illustrating aspects of the male (414) and female (1014) alignment fixtures. FIGS. 12-15 further illustrate various operational aspects of the male and female alignment fixtures engaging or engaged.

FIG. 17 schematically illustrates optional extended landing structures 1700 that can be attached to the female alignment fixtures 1014 to facilitate docking between the ROV and the suspended machinery.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

We claim:

1. An apparatus enabling the coupling by an in-transit ROV in a water column with an in-transit suspended machinery in the water column that is suspended from a link from an in transit marine surface vessel, platform, or other surface or sub-surface structure, comprising:

a suspended machinery;

an ROV;

at least one docking assembly including a capture collar disposed in one of the ROV and the suspended machinery;

a linearly extendable/retractable harpoon respectively disposed in one of the suspended machinery and the ROV; and actuating machinery associated with the extendable/retractable harpoon to controllably effect linear extension and retraction thereof.

2. The apparatus of 1, wherein a distal end of the harpoon includes a controllable capture collar latching mechanism.

3. The apparatus of 2, wherein the controllable capture collar latching mechanism includes a retractable component in the form of a barb or a finger.

4. The apparatus of 1, wherein the capture collar has a front end and a back end, further wherein the capture collar is characterized by a cone-like geometry having a progressively narrowing dimension between the two ends.

5. The apparatus of 1, wherein the harpoon is rigid.

6. The apparatus of 2, wherein the controllable latching mechanism is remotely activatable.

7. The apparatus of 1, further comprising a set of complimentary alignment fixtures attached to respective ones of the ROV and the suspended machinery.

8. The apparatus of 7, wherein the set of complimentary alignment fixtures comprises an elongate male structure and a female structure that can engage the male structure.

9. The apparatus of 8, wherein the female alignment fixture is disposed on the suspended machinery and the male alignment fixture is disposed on the ROV.

10. The apparatus of 8, wherein the female alignment fixture is disposed on the ROV and the male alignment fixture is disposed on the suspended machinery.

11. The apparatus of 1, further comprising a payload cage in which resides at least one of the at least one docking assembly including a capture collar and the extendable/retractable harpoon and the associated actuating machinery, wherein the payload cage has a capacity for receiving, holding, and discharging a unit payload.

12. A method for coupling an in-transit ROV in a water column with an in-transit suspended machinery in the water column that is suspended from a link from an in-transit marine surface vessel, platform, or other surface or sub-surface structure, comprising:

providing the in-transit suspended machinery having at least one docking assembly including a capture collar;

providing the in-transit ROV having a linearly extendable/retractable harpoon and associated actuating machinery;

approaching the in-transit suspended machinery with the ROV, wherein the linearly extendable/retractable harpoon is partially extended, wherein the partially extended harpoon is aligned with the capture collar on the suspended machinery;

maneuvering the ROV so as to bring an end of the partially extended harpoon into aligned proximity with the capture collar; and further linearly extending the harpoon so that it passes through and securely engages the capture collar.

13. The method of 12, further comprising at least partially retracting the engaged harpoon so as to draw the ROV and the suspended machinery closer to one another into a securely coupled arrangement.

14. The method of 12, further comprising activating a latching mechanism on a distal end of the harpoon to securely engage the capture collar.

15. The method of 13, further comprising transferring a unit payload disposed within at least one of the ROV and the suspended machinery to the respective suspended machinery and the ROV.

16. The method of 12, further comprising de-activating a latching mechanism on a distal end of the harpoon and reducing an in-transit speed of the ROV to a value that is less than the in-transit speed of the suspended machinery so as to increase the separation distance between the in-transit suspended machinery and the ROV.

* * * * *